US009868154B2

(12) United States Patent
Hawes

(10) Patent No.: US 9,868,154 B2
(45) Date of Patent: Jan. 16, 2018

(54) THREE-DIMENSIONAL MOLDING USING MAGNETICALLY ACTIVATED STATIC AND DYNAMIC FERROFLUID CONFIGURATIONS

(71) Applicant: Eleanor Augusta Hawes, Lexington, KY (US)

(72) Inventor: Eleanor Augusta Hawes, Lexington, KY (US)

(73) Assignee: Hummingbird Nano, Inc., Lexington, KY (US)

( * ) Notice: Subject to any disclaimer, the term of this patent is extended or adjusted under 35 U.S.C. 154(b) by 561 days.

(21) Appl. No.: 14/460,573

(22) Filed: Aug. 15, 2014

(65) Prior Publication Data

US 2015/0050179 A1 Feb. 19, 2015

Related U.S. Application Data

(60) Provisional application No. 61/866,757, filed on Aug. 16, 2013.

(51) Int. Cl.

| | |
|---|---|
| ***B22F 3/087*** | (2006.01) |
| ***B22F 3/105*** | (2006.01) |
| ***B22F 5/00*** | (2006.01) |
| *B22F 5/10* | (2006.01) |

(52) U.S. Cl.

CPC ..... *B22F 5/007* (2013.01); *B22F 2003/1053* (2013.01); *B22F 2005/103* (2013.01); *B22F 2202/05* (2013.01); *B22F 2999/00* (2013.01)

(58) Field of Classification Search

CPC ..... B22F 2202/05; B22F 2005/103; B22F 2003/1053; B22F 5/007

USPC ..... 419/38

See application file for complete search history.

(56) References Cited

FOREIGN PATENT DOCUMENTS

WO WO 2011055347 A2 * 5/2011 ..... B29C 33/38

OTHER PUBLICATIONS

Lee, Chiun Peng, Yi Hsin Chen, and Mei Feng Lai. "Ferrofluid-molding Method for Polymeric Microlens Arrays Fabrication." Microfluidics and Nanofluidics 16.1-2 (2013): 179-86. Web.*

W. B. Song, H. Kim, C. Son and B. Ziaie, "Fabrication of Polymeric 3-D Micro-Structures Using Ferrofluid Molds," 19th IEEE International Conference on Micro Electro Mechanical Systems, Istanbul, Turkey, 2006, pp. 334-337.*

* cited by examiner

*Primary Examiner* — Colleen Dunn
*Assistant Examiner* — Jeremy Jones
(74) *Attorney, Agent, or Firm* — Tungsten IP

(57) ABSTRACT

A method for creating a dynamic mold from a ferrofluid substrate in or adjacent to curable molding material is disclosed. A combination of magnetic elements is used to create a magnetic field that is capable of concentrating a ferrofluid substrate in a 3-D space. The ferrofluid substrate shapes a molding material to effect its shape. The ferrofluid, under the influence of a magnetic field, is capable of creating surface features and internal features in the molding material. Once cured or partially cured, the ferrofluid may be removed, resulting in features that are difficult to form by conventional methods.

11 Claims, 11 Drawing Sheets

A)

B)

C)

D)

E)

D)

E)

A)

B)

C)

D)

E)

THREE-DIMENSIONAL MOLDING USING MAGNETICALLY ACTIVATED STATIC AND DYNAMIC FERROFLUID CONFIGURATIONS

RELATED APPLICATIONS

This application claims priority to U.S. Provisional Patent Applications 61/866,757, filed Aug. 16, 2013, all of which is hereby incorporated by reference herein in its entirety.

FIELD OF THE INVENTION

The present invention relates to the fields of solid freeform fabrication, three-dimensional printing, and micro-molding.

BACKGROUND OF THE INVENTION

Patent application (WO2011055347) describes the use of a semiconductor chip device (such as a CMOS chip) with electrically energized circuits designed to create varying/dynamic magnetic fields perpendicular to a planar surface that is coated with a layer of ferrofluid. The device is used for forming features in a curable material on a planar surface above the chip. The application of the invention is limited to forming objects that may be deformed from a planar surface, such as optical lenses.

BRIEF SUMMARY OF THE INVENTION

The present invention comprises a method directed to curable molding materials (30) (such as polymers, plastics, metals, ceramics) that are molded against the shape and flow of a mold (20) which includes a ferrofluid substrate (10) and a mold (20) that takes place within the space of a magnetic system (not shown). The ferrofluid substrate may be formed into any desired shape which may include spheres, cylinders, curved tubes or planes that may have any angular orientation relative to the mold.

The ferrofluid substrate is a fluid that aligns in the direction of a magnetic field. The shape and flow of the ferrofluid substrate can be manipulated by magnetic fields around the ferrofluid substrate. Ferrofluid is a man-made material. The dynamics and attributes of ferrofluid are an active area of academic study and have been since the material was first made in 1963. The most-well known application of ferrofluid is in artistic sculptures, but ferrofluid has found particular application as an actuating material, whereby it enables switches, sensors and pumps in mechanical systems. The magnetic fields in turn can be organized by the magnetic system.

A 'magnetic system' refers to a system comprised of magnets, such as permanent and/or electromagnets that are capable of forming static or dynamic magnetic fields, and may also include metallic materials in a two or three dimensional configuration. The magnetic system is configured around a central space in which the molding material is contacted against a mold, wherein the ferrofluid substrate is affected by magnetic fields, such that the ferrofluid substrate may orient a particular way in the presence of a magnetic field. 'Magnetic material' refers to one or more magnets or one or more metallic material where the one or more metallic materials is under the influence of a magnetic field. Metallic materials may be, for example, a metal gage wire, a metal rod, or a sheet metal component. Magnetic 'strength', such as 'weaker' or 'stronger' magnets, refer to magnetic field density.

The magnetic system configuration may be arranged such that a concentration of field lines formed by the magnetic system serve as the basic map for the flow direction of the ferrofluid substrate. The shape may be narrowed and refined, or "guided", by the metallic materials within the central space that are aligned with the magnets. The metallic materials may additionally dam or bridge flow between magnets, allowing for a more diverse range of patterns and shapes to be achieved by the magnets. The metallic materials may serve as a focus for the magnetic field lines; those produced by the magnets alone have directionality but not singularity, and the metallic materials may provide for shapes and flow, such as individual lines on the order of microns, to be singular features. Similarly, placing a bend on a gauge wire may allow the ferrofluid to follow the path of the bent wire as it focuses the magnetic field, increasing its concentration. Metallic materials, such as a gauge wire, can additionally create a 'bridge' to allow for flow between two or more magnetic elements. Introducing a ferrofluid substrate at a first weaker magnet, the ferrofluid substrate can flow toward a stronger second magnet, following the path of the metallic material, moving from the weaker to the stronger magnet. Likewise repulsive field effects can be introduced in the magnetic system, such as placing a metallic material tangentially between two magnets (north pole to north pole), and allowing the field lines to repel in the direction of the metallic material.

Magnets can also be placed in a three-dimensional system. For example, ferrofluid substrate placed between two cylindrical magnets will create an hourglass shape. Placing a metallic material, such as a wire, between these can elongate the hourglass shape but allow the ferrofluid substrate to maintain continuity. In another configuration, the ferrofluid substrate can be held to a surface by one magnet, and by placing another in proximity can create arcs and wave-like shapes that can then be molded.

By focusing and concentrating magnetic field lines and densities via the magnetic system, the ferrofluid substrate can be moved dynamically and formed into a specific shape.

To assist the ferrofluid substrate in obtaining the desired shape and position, a curable molding material (in fluid or powder form) can be introduced within the central space of the magnetic system prior to introducing the ferrofluid. The molding material is then molded against the specific shape of the ferrofluid substrate by curing the molding material using common methods (light, heat, or time). "Molding materials" are those such as photopolymers, powder metals, ceramics, or any used in current three-dimensional printing techniques.

The interaction of the curing materials and ferrofluid substrate can be viewed as analogous to three different processes, a) where the ferrofluid substrate may be a fixed mold cavity, b) where the ferrofluid substrate may be a resist, and c) where the ferrofluid substrate may be in a dynamic state. In the case of (a) for static configurations, the use of powdered metals are of particular import in terms of improving the art.

The ferrofluid substrate can also be used as a heat transport mechanism for induction heating via varying magnetic fields. The curing method (40) and interaction with the ferrofluid substrate will change according to the curing material used. A photopolymer requires a (typically) ultraviolet light source, which limits the system to those that need the curing material to 'see' the light source. A powdered metal requires heat, which allows for a greater variety of molding shapes, but alters the specifications for the ferrofluid substrate so that it does not evaporate.

The ferrofluid substrate's shape can be changed dynamically during the curing step to further impact the final shape of the cured mold. The present method permits fast three-dimensional molding in a programmable fashion.

A non-magnetic fluid substrate (such as water) may be used within the space of the magnetic system to shape the ferrofluid substrate and/or mold material by acting as a barrier or a guide. The non-magnetic substrate may also function as a surface against which the curing molding material can mold, such as in areas where the presence of ferrofluid is not desirable, such as planar surfaces adjacent to ferrofluidic substrate features.

DETAILED DESCRIPTION OF THE INVENTION

Figure 1:
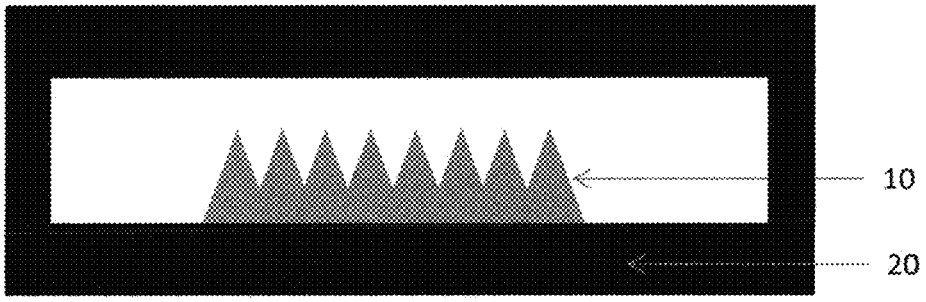
FIG. 1 shows a summary of steps 1a-1e of Process Method 1, whereby the molding material is molded against the ferrofluid shape using a static magnetic field strength distribution.
Figure 1:
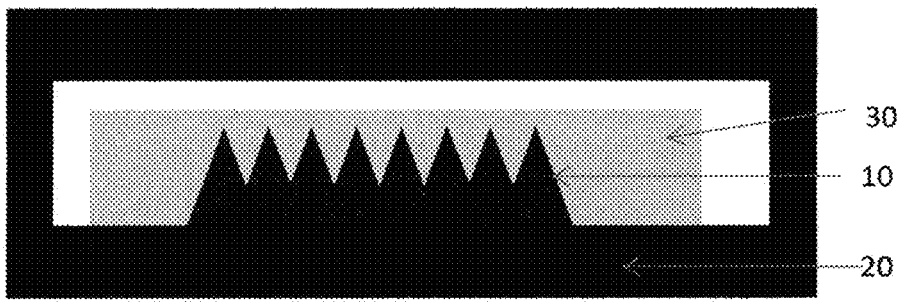
Figure 1:
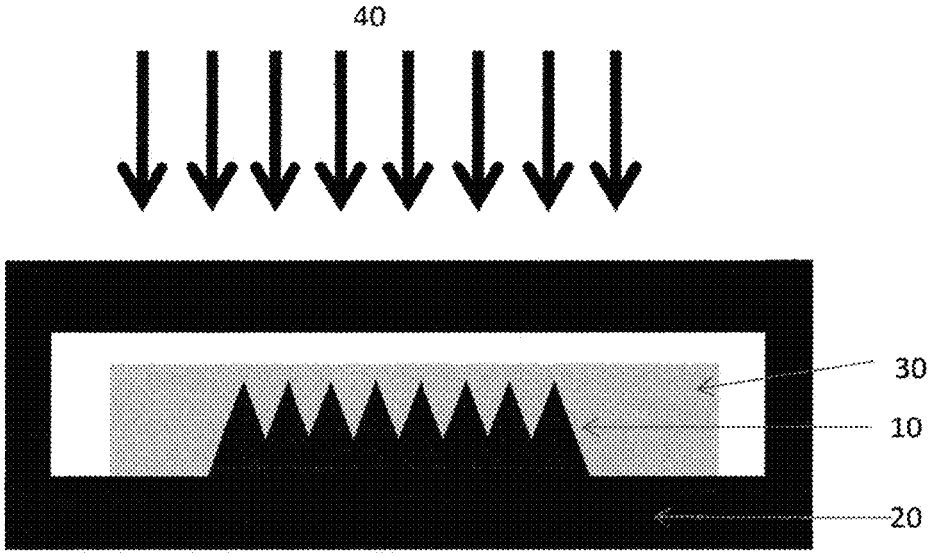
Figure 1:
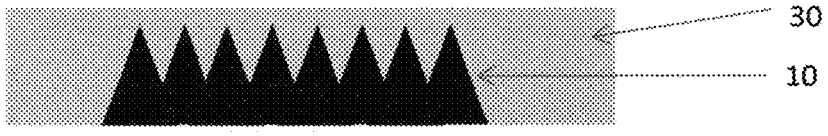
Figure 1:
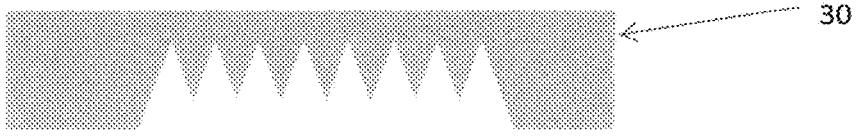

The present invention provides a molding method capable of forming molded features by use of a ferrofluid substrate material shaped with a magnetic system. The method of the present invention comprises utilizing a magnetic system to manipulate within a three-dimensional (3-D) central space a shape of a mold comprising a ferrofluid substrate and introducing a molding material to form a molded feature against the first shape of the ferrofluid substrate. The method may further comprise altering the shape of the ferrofluid substrate by adjusting the magnetic system after the molding material has been introduced or as the molding material cures. The magnetic system comprises a two or three-dimensional system of magnetic (permanent and/or electromagnetic) elements, and optionally includes metallic materials, which in combination map a ferrofluid substrate to a desired shape for forming a surface feature or an interior channel, wherein the ferrofluid substrate takes the shape of the resulting magnetic field lines. The present invention may use a ferrofluid substrate as part of a molding surface that allows for shapes beyond static configurations, such as features created by fluid flow and complex features that result from the application of ferrofluid substrate in a multi-dimensional magnetic system. The materials and curing method (40) may be variable within the process and those skilled in the art will appreciate that the specific configurations of the materials and associated curing method may vary based on the molding material being used. The magnetic system provides a tool to direct magnetic field lines and ferrofluid flow.

A mold may be created against which a molding material may be contacted and shaped around. The mold comprises a ferrofluid substrate and a non-magnetic mold material, such as a non-magnetic metal (those having a, paramagnetic material, or a polymer. A ferrofluid substrate (also "ferrofluid"), as is known in the art, refers to a material comprised of magnetic particles, surfactant and carrier fluid. The carrier fluid can be hydrophobic, hydrophilic, or any fluid which can carry a surfactant. Ferrofluids have been used in a variety of industries such as components in sensors, liquid seals, switches, loudspeakers, solenoids, dampers, drug delivery, ink-jet printing, and sink-float material separator systems. Ferrofluid is a stable substance comprised of colloidal nanoparticulate magnetite or iron oxide (or other magnetic materials) coated with surfactant such as oleic acid, citric acid, soy lecithin, tetramethlyammonium hydroxide, and in suspension in a carrier fluid. The versatility of the carrier substance, which can be oil, water or diester, provides a wide berth of possibilities for interactions with molding substances. (See, Williams, A. M., 2008. The Hydrodynamics of Ferrofluid Aggregates. Virginia Polytechnic Institute and State University, Blacksburg, Va.). When in the presence of a magnetic field, the fluid shifts in order to align itself along the magnetic field lines, as is similarly seen with iron filings around a magnet. However, the surface tension of the ferrofluid cannot typically hold the full circular contour of a magnetic field. This effect is most dramatically witnessed when the magnetic field is normal to the ferrofluid, and the ferrofluid in turn resolves itself into cone like structures, the size and shape of which are determined by the strength of the magnetic field in that location.

The behavior of the ferrofluids is referred to as 'instability,' and the behavior can be variously described by normal field, labyrinthine, Rayleigh-Taylor and Kelvin-Helmholtz instabilities. (See, Bacri, J. C. and D. Salin. Instability of ferrofluid magnetic drops under magnetic field. Journal de Physique-Lettres. No. 17, pp. 650, 1982). These behaviors do not correlate directly to a magnetic field, as the behavior is additionally dependent on whether the applied magnetic field has been present and is now decreasing. (See, Mayer, D. Future of electrotechnics: Ferrofluids. Advances in Electrical and Electronic Engineering. Pp. 9 and Dickstein, A. J., S. Erramilli, R. E. Goldstein, D. P. Jackson and S. A. Langer. Labyrinthine Pattern Formation in Magnetic Fluids. Science, New Series, Vole. 261, No. 5124, Aug. 20, 1993, 1012-1015) The normal field, or Rosenweig instability, occurs when a magnetic field is applied normally to the ferrofluid surface. This instability has different states, as the peaks of the ferrofluid shift from hexagonal to square with increasing field strength. The ferrofluid is further more sensitive to the magnetic field when the magnetic field is increasing than when it is decreasing in strength. (See, Buzduga, C., V. Vlad, C. Ciufudean. Experimenting the Stability of Ferrofluids. Mathematical Models in Engineering and Computer Science Conference Paper, 2013, pp. 80). The magnetic field strength is normally measured in amperes per meter (A/m), denoted by "H". The effect of a step-function change versus gradual change of the magnetic field strength ("H") may also influence the shape and the growth of peaks; one magnetic field does not necessarily provide one equivalent ferrofluid shape, and the method of producing that field is of equal importance in operating the magnetic system.

Relationships between the peak profile and radius of curvature of the fluid with respect to the magnetic field strength, the peak density as a function of magnetic field strength (see, Strek, T. Chapter 28, Finite element simulation of heat transfer in ferrofluid. Modelling and Simulation. Pp. 533. I-Tech Education and Publishing, June 2008), the transfer of heat through ferrofluids (see, Brullot, W., N. K. Reddy, J. Wouters, V. K. Valev, B. Goderis, J. Vermant, T. Verbiest. Versatile ferrofluids based on polyethylene glycol coated iron oxide nanoparticles. Journal of Magnetism and Magnetic Materials, 324, 2012, 1919-1925), the stability, dynamics of feature formation, variations in composition and resulting effects, saturation of magnetic particles with respect to viscosity and magnetization (see, Zelazo, R. E. and J. R. Melcher. Dynamics and stability of ferrofluids: surface interactions. Journal of Fluid Mechanics, 1969, Vol 39, part 1, pp. 1-24 and Webster, J. R., M. A. Burns, D. T. Burke and C. H. Mastrangelo. An inexpensive plastic technology for microfabricated capillary electrophoresis chips. Micro Total Analysis Systems '98. 1998, pp. 249-252): all of these have been investigated in academic literature and are understood in the art.

In contrast, a non-typical use of ferrofluids is to operate in the magnetic field intensity below the Rosensweig instability. In doing so, the ferrofluid is shaped along a line of concentrated magnetic field strength allowing for shapes such as cylinders, spheres, curved tubes and planes, without the recurring peaks along their length.

The ferrofluid substrate may be immiscible or exhibit reduced miscibility with the molding material and therefore the two will not intrinsically homogenize together. Immiscibility of the molding material with the ferrofluid substrate allows for the mold to form. Selecting immiscible materials is known in the art, such as using hydrophobic materials with hydrophilic materials or polarized materials with non-polar materials. For example, a molding material may be a hydrophilic material (such as Sartomer 399), or a hydrophobic material, such as functionalized Sartomer 351, or partially hydrophilic (such as Sartomer 351 LV). In instances that use powdered materials for a curing material, the magnetized ferrofluid substrate may be denser than the powdered curing material. In instances where the molding material is hydrophilic, the carrier fluid of the ferrofluid substrate may be a hydrophobic material (such as synthetic oil, an animal oil or a vegetable oil), or can be hydrophobic; water itself may be used as a carrier fluid.

In instances where the molding material is thermoplastic, the ferrofluid substrate must function within regions of high temperature. In instances where non-magnetic fluid material is use The carrier fluid of the ferrofluid substrate may comprise a hydrophobic material such as oil or a hydrophilic material (such as water). The choice of carrier fluid may affect the miscibility of the ferrofluid substrate with the molding material. Those skilled in the art will appreciate that reduced miscibility with the molding material may allow for better or improved molding. Those skilled in the art will also appreciate that the choice of carrier fluid may additionally allow for varying temperature ranges within the ferrofluid substrate during the curing process of the molding material. For example, a three-dimensional printer using a high powered 200 watt Yb-fiber optic laser to melt a 20 micron layer of stainless steel will raise the temperature of the steel to approximately 1500° C.; the temperature to achieve fusion is lower than bulk metals because the material is in powder form. Typical stainless steels have a specific heat of around 500 J/kg*K; that is, 500 joules of energy to raise a kilogram of stainless steel by one degree. Water is 4.187 kJ/kg*K, over eight times that of stainless less, which means that it takes longer to heat than stainless steel. The melting temperatures of the two substances 100° C. versus 1500° C., dictates that to maintain the shape of the ferrofluid substrate three methods may be employed, either separately or in combination: 1) provide an increased depth of ferrofluid substrate that is capable of absorbing the energy transfer from the melted stainless steel; 2) provide an increased flow rate of ferrofluid substrate that is capable of carrying the energy downstream; 3) introducing a thin layer of non-magnetic fluid above the ferrofluid substrate for use as a thermal shield/sacrificial layer.

For powdered metals with ferrous material in the powder, the ferrofluid substrate can be rapidly alternated to induce heating of the molding material. The fluid flow of the ferrofluid may then be continuous, and accordingly prevent overheating. A few degrees prior to achieving melting temperature, the alternating field may be stopped to allow the ferrofluid substrate to take the final required shape, thus allowing the metal to be molded accordingly.

The present invention also provides for contacting a molding material against a mold comprising a combination of ferrofluid substrate and non-magnetic fluid substrate. The non-magnetic fluid substrate can interact with the ferrofluid substrate in either a miscible or immiscible manner. Immiscible non-magnetic fluid substrates serve a similar function to the ferrofluid substrate, i.e. a surface which serves as a mold cavity. Miscible non-magnetic substrates may interact with the molding material to alter the final shape outcome and change surface characteristics. For example, once the ferrofluid substrate is aligned with the magnetic field, a non-magnetic immiscible fluid may be placed adjacent to the ferrofluid substrate to alter the shape of the ferrofluid substrate. The non-magnetic fluid substrate may also be in place prior to the application of the ferrofluid substrate, and the ferrofluid substrate may a) move around an immiscible non-magnetic fluid substrate and/or b) move through the non-magnetic fluid substrate.

The present invention provides for contacting a molding material against a mold (20), such as a combination of ferrofluid substrate and non-magnetic substrate. The molding material may be a solid or a liquid. The molding material may have reduced miscibility with the ferrofluid substrate. The molding material may be immiscible with the ferrofluid substrate. The molding material may be a photopolymer, such as Sartomer 399, SUB, PMMA, PDMS, or Sartomer 351. As is known in the art, a photopolymer may cure following exposure to particular wavelengths of light. As is known in the art, the wavelength required to cure the photopolymer is dependent on the selected photopolymer. For example, photopolymers such as Sartomer 351 HP uses ultraviolet wavelengths to cure between 300-380 nm, SU-8 cures at 365 nm, and polymethyl methacrylate (commonly referred to as PMMA) cures at 248 nm. The penetration depth and cure time of the photopolymer are also dependent on the photopolymer selected.

The molding material may further be a solid, such as powder, including powdered metals such as 304 stainless steel, ferritic steel, cobalt alloys, copper alloys, or austenitic nickel-chromium-based superalloy (sold under the trademark Inconel). Other powdered metals, in addition to alloys in a powdered form, may also be used. These powdered metals may be the same as those used in Solid Freeform Fabrication processes. As is also understood within the art, powdered metals may be cured by laser application, radiative heat or other similarly known methods.

The ferrofluid substrate may be shaped based on the presence of magnetic particles within the ferrofluid substrate reacting to a surrounding magnetic system. The mold may be held in a desired shape through the use of a magnetic field applied by the magnetic system to the ferrofluid substrate. The magnetic particles within the ferrofluid substrate will attempt to align in the direction of the applied magnetic field lines and according to the field strength distribution applied. The resulting shape of the ferrofluid substrate therefore depends on the direction, distribution and strength of the applied magnetic fields from the surrounding magnetic system. The magnetic field strength may be limited by the magnet used (permanent or electromagnet) and by the physical distance between each magnet (or magnetic material) and the ferrofluid substrate. Controlling these factors is known in the art of magnetic control (See, e.g., Paul, C. R. and S. A. Nasar, Introduction to Electromagnetic Fields, McGraw-Hill, 1982 and Hanselman, D. C., Brushless Permanent-Magnet Motor Design, McGraw-Hill, 1994).

Figure 7:
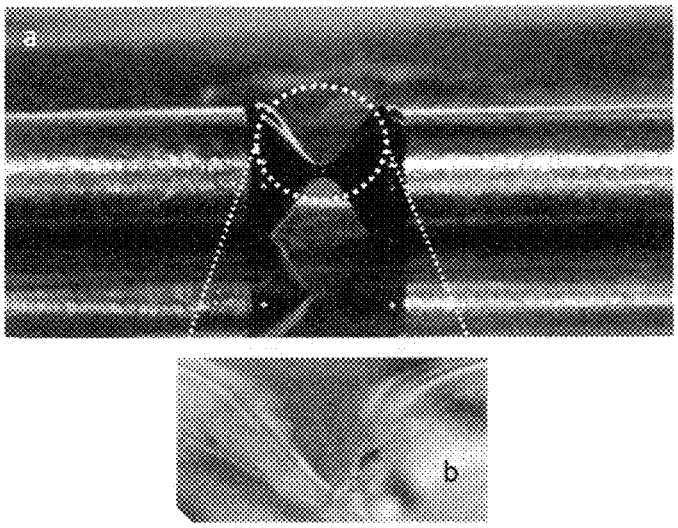
FIG. 7 shows an example of a molded material in a three-dimensional configuration

The ability to shape the mold may also be affected by the surface tension of the ferrofluid substrate, viscosity of the molding materials, and the volume of the ferrofluid substrate. The surface tension is a result of the carrier fluid and the strength of the magnetic field within the ferrofluid substrate. Selecting for lower surface tension allows the ferrofluid substrate to create finer features. The volume of the ferrofluid substrate may further change the resulting shape of the ferrofluid. For example, when placed in proximity to a normal magnetic field (the Rosenweig instability), the ferrofluid substrate may form conical peaks. Small changes in volume may effectively change the strength of the magnetic field, thereby allowing the base of the resulting peaks to range from spherical to square to hexagonal. (See, Buzduga, C., V. Vlad, C. Ciufudean. Experimenting the Stability of Ferrofluids. Mathematical Models in Engineering and Computer Science Conference Paper, 2013, pp. 80). Using a three-dimensional configuration, such as that shown in FIG. 7, may increase complexity of the ferrofluid substrate formation. FIG. 7 in particular shows an hourglass shape resulting from magnets placed normally to the ferrofluid. Molding shapes such as these is not currently possible with a single dimensional (planar) system, and the addition of metallic elements to alter ferrofluid substrate formations further increases the complexity of mold cavities. When using the dynamic flow of the ferrofluid substrate to mold, the volume of the ferrofluid per time unit may alter the molding shape, which is known in the art of fluid dynamics (See Odenbach, S. Colloidal Magnetic Fluids: Basics, Development and Applications of Ferrofluids, Springer, 2009). The presence of a surfactant within the ferrofluid substrate may also adjust the surface tension of the ferrofluid. The presence of a surfactant may also inhibit the magnetic particles from agglomerating, which can increase the overall stability of the ferrofluid substrate.

Upon exposure to a magnetic field, the apparent viscosity of the ferrofluid substrate may change. Those skilled in the art will appreciate that a higher intensity magnetic field allows for a more viscous ferrofluid substrate. Increased viscosity aids in molding because the fluid becomes effectively gel-like, creating a stronger force against which to mold. Further, increasing the viscosity of the molding material aids in molding because the ease of movement of a gel-like ferrofluid substrate within a high viscosity medium improves shape and position controllability using the magnetic system.

The present invention also provides for a magnetic system to surround the molding material in a central space. The magnetic system configuration may be arranged such that the field lines of the magnet serve as the basic map for the flow direction of the ferrofluid substrate. The shape may be narrowed and refined, or "guided", by the metallic materials that may be present within the central space that align with the magnets as a magnetic field is applied. The metallic materials may additionally dam or bridge flow between magnets of the magnetic system, allowing for a more diverse range of patterns and shapes to be achieved by the magnets. The metallic materials within the central space may also serve as a focus for the magnetic field lines; those produced by the magnets alone have directionality but not singularity, and the intermediary metallic elements assist to provide for shapes and flow, such as individual lines on the order of microns, to be singular features. For example, placing a gauge wire on a magnet, aligned with the direction of the magnetic field, and covered by a metallic shim will create a single line of ferrofluid; placing a bend on the magnet wire will allow the ferrofluid to follow the path of the bent wire. Without the gauge wire, the ferrofluid substrate would spread directionally in line with the magnetic field lines, creating multiple parallel lines along the magnet, but not a singular feature. Metallic elements within the central space, such as a gauge wire, can additionally create a 'bridge' to allow for flow between two magnets. For example, by placing a metal wire or razor between two magnets, one of greater strength than the other, and introducing the ferrofluid substrate to the weaker magnet, the ferrofluid substrate can flow between the magnets, following the path of the metallic element, moving from the weaker to the stronger magnet. Likewise repulsive field effects can be introduced within the magnetic system, such as placing a metallic element tangentially between two magnets (north pole to north pole), and allowing the field lines to repel in the direction of the metallic element. Magnets can also be arranged in a three-dimensional system. For example, ferrofluid substrate placed between two cylindrical magnets will create an hourglass shape. Placing a wire between these can elongate the hourglass shape but allow the ferrofluid substrate to maintain continuity. In another configuration, the ferrofluid substrate can be held to a surface by one magnet, and by placing another in proximity can create arcs and wave-like shapes that can be molded.

The present invention also relates to dynamic, flowing molds. The use of magnetism can provide for highly directed flow, allowing dynamic flow systems to be molded, such as that seen with highly controlled micro jet manufacturing. When ferrofluid substrate is constantly input into the system, the flow of the ferrofluid is directed by the magnetic system in place. For example, placing a ferrofluid substrate bath against two magnets with opposing poles in proximity to one another, the ferrofluid substrate will be pulled to the location with the highest field density, i.e., between the two magnets. A continuous input of ferrofluid substrate away from the location between the magnets, but still within the magnetic field, may therefore flow to that central location. Putting uncured or partially cured molding material on the ferrofluid substrate and curing that material as the ferrofluid substrate flows may allow those flow lines to be molded. In another example, a curing material volume is set within a central space within the magnetic system that allows ferrofluid substrate to flow through the curing material. The material is cured as the ferrofluid flows between the magnets and through the curing material, thereby creating a mold that has a channel. Those familiar with the fluidic systems art can appreciate that the flow created can take many forms, dependent on the flow factors (e.g., rate, volume etc.) applied.

The magnetic system may use any combination of 'magnetic foci', metallic elements and 'guiding' magnets. The field lines of magnets are at various locations straight and curved, and these lines may interact, either via attraction or repulsion, with other magnets present within the magnetic system. Manipulation of these field lines requires taking the natural direction of the field within a particular magnet and applying how it will interact with other magnets and metallic elements within a defined proximity. These are properties that are understood by those skilled in the art. The mold shape may be defined by the organization of the surrounding magnets such that the flow, shape and behavior of the ferrofluid substrate can be predicted. The ferrofluid substrate may then flow and/or align according to the direction and density of the field lines. These field lines result in singular or complex molded features with the addition of metallic elements within the magnetic system.

Figure 4:
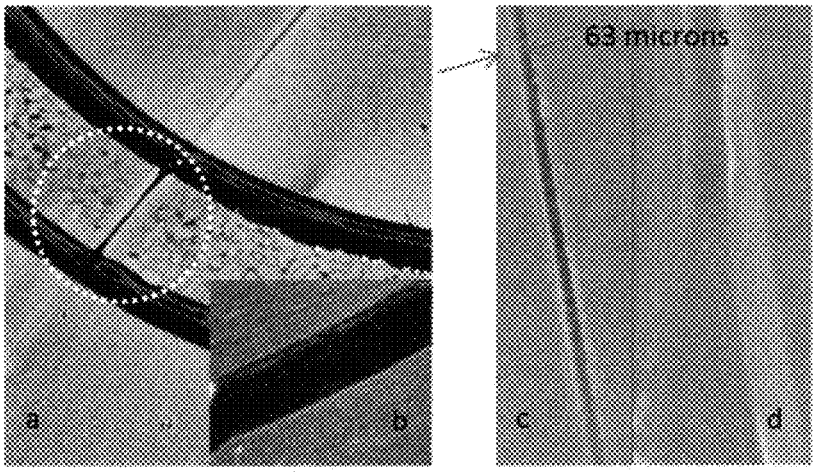
FIG. 4 shows an example of energized ferrofluid with dynamic input (50) and output (60) flow and resulting mold.

The magnetic foci may be permanent magnets or electromagnets to create a generalized field intensity that may influence the ferrofluid substrate. Metallic elements, such as paramagnets and non-magnetic materials, can be placed in proximity to magnetic foci to allow the mold to form a specific shape. FIG. 4 shows an example of this, where the magnetic foci is an annular permanent magnet. A non-magnetic wire, 100 microns in diameter, is placed above the magnet and a non-magnetic metal sheet is placed above that system. The non-magnetic wire can be seen to create an individual line, following and concentrating the field lines of the magnetic foci. Non-magnetic materials can also be applied to block and diffuse the magnetic fields.

Figure 5:
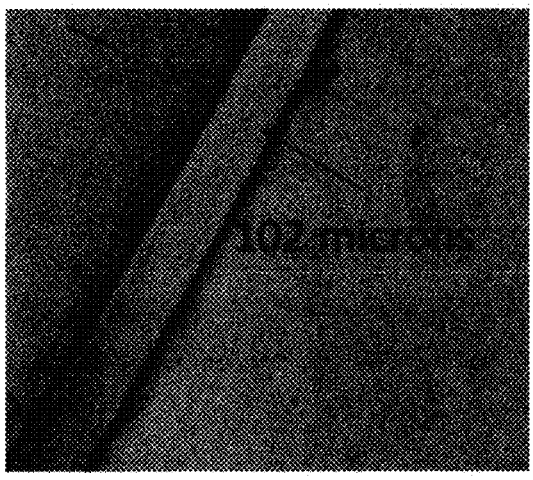
FIG. 5 shows an example of a mold resulting from directed ferrofluid flow creating a channel on the interior of the molding material.
Figure 6:
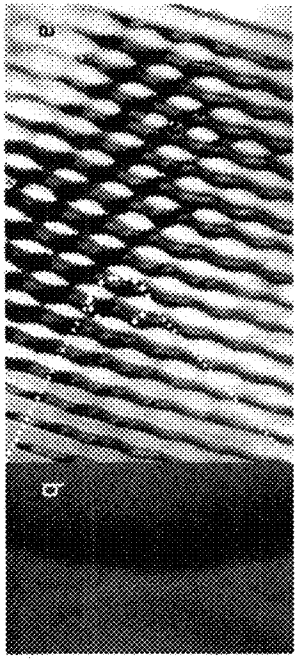
FIG. 6 shows an example of a molded material against multi-dimensionally configured field lines.

Guiding magnets may also be used within the magnetic system to direct flow of the ferrofluid substrate. FIG. 5 shows an exemplary result of ferrofluid substrate pulled from one magnet to another across a photopolymer that was cured while flow occurred.

Accordingly, these three elements of the magnetic system can be used in conjunction with one another to achieve the desired molding shape.

The present invention provides for a molding material to be applied to the ferrofluid substrate within a central space of the magnetic system. The molding material should have a low miscibility with the ferrofluid substrate to prevent or reduce mixing with the ferrofluid substrate. The molding material may be introduced to the ferrofluid substrate as a solid or as a fluid. The fluid-state molding materials are applied volumetrically according to the curing limitations for the molding material (penetration depth of curing energy). For example, using ultraviolet light to cure Sartomer 399, several millimeters of photopolymer can be molded without layering, whereas SU8 and other photopolymers have penetration depths limited to hundreds of microns. Powdered materials can be applied using a more layered approach, the volume again dependent on the curing requirements. If induction or ovens are used to heat the powder, higher volumes of powder can be fused at one time. Using lasers, as three-dimensional printers typically do, layers of up to 20 microns are typically fused at a time, although the penetration depth of lasers in typical systems suggest a maximum of 500 microns. Curing using a directed radiative source may impose volumetric limits because the wavelength applied may be absorbed within a given distance. The specific distance may depend on the curing material's absorption of light.

Curing the molding material may require exposure to high temperatures and cooling at a specified rate. To prevent heating of the ferrofluid substrate when high heat is applied to the molding material, a fluidic thermal shield can be used, the carrier fluid can be used to absorb the heat, or the depth of the applied molding material on the ferrofluid can be equal to or greater than that of the radiative heating method to prevent penetration to the ferrofluid layer.

The present invention can further use plastics or ceramics as the molding material to be cured, where the application of these materials is in liquid or powder form and parallels the considerations for photopolymer and metals.

The interaction between the molding material and the ferrofluid substrate may be analogous to three known behaviors.

A. The ferrofluid substrate is used in the manner of a traditional mold. Molding material is applied against the shape of the fluid. A curing method (heat, light, solvent) is applied, allowing the molding material to take the shape of the ferrofluid. The process concept is shown in FIG. 1.

Figure 2:
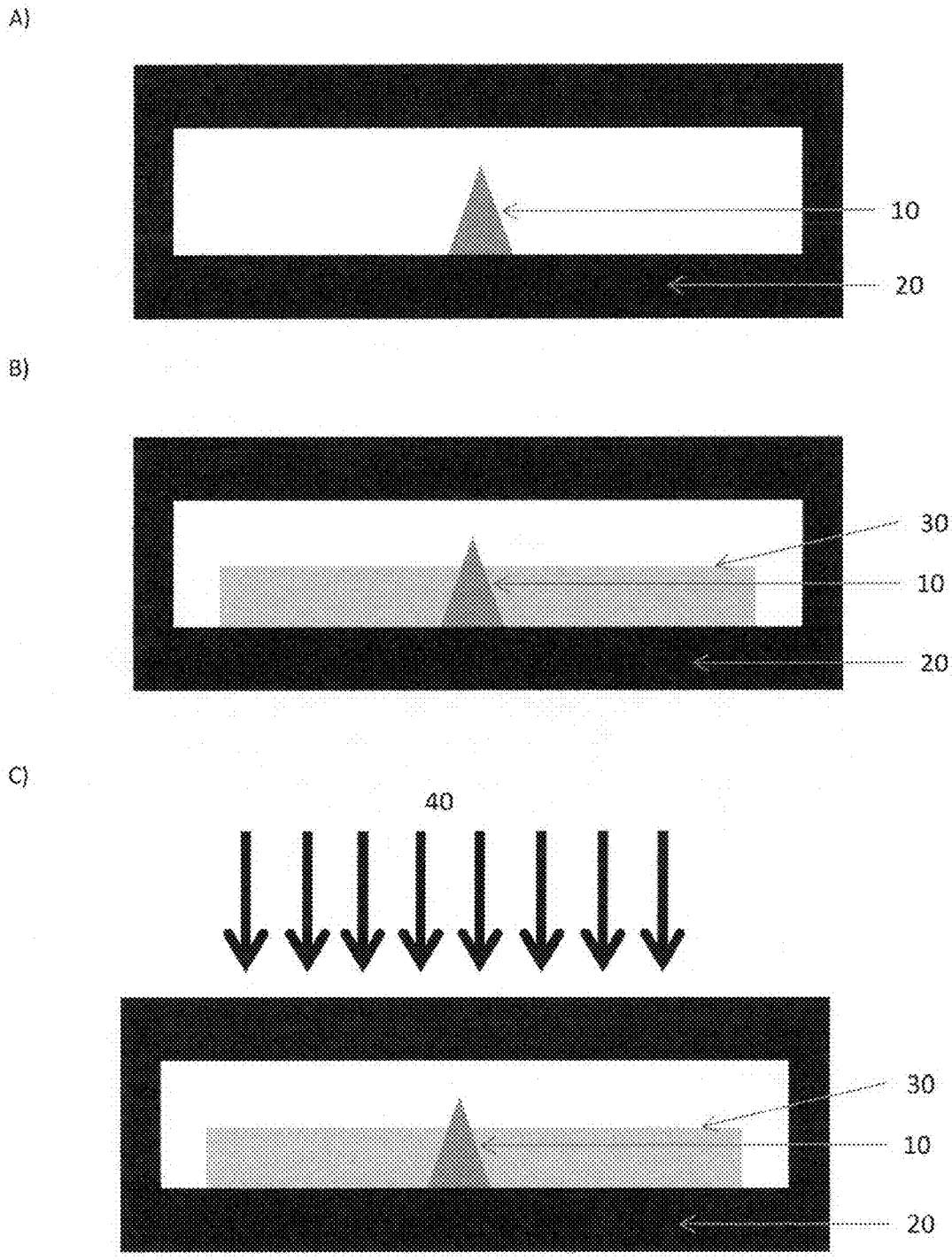
FIG. 2 shows a summary of steps 2a-2e of Process Method 2, whereby the molding material is molded in a manner where the ferrofluid behaves analogously to a photoresist material.
Figure 2:
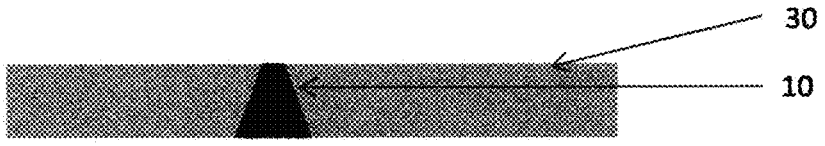
Figure 2:
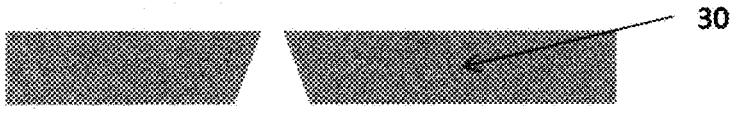

B. The ferrofluid substrate behaves in a manner analogous to a resist. Molding material is applied such that it surrounds the ferrofluid. The combination of the increased apparent viscosity due to magnetization and immiscible qualities of the ferrofluid substrate and molding material prevent the molding material from entering the areas defined by the ferrofluid. A curing method (heat, light, solvent) is applied, allowing the molding material to take the shape voided by the ferrofluid. The process concept is shown in FIG. 2.

Figure 3:
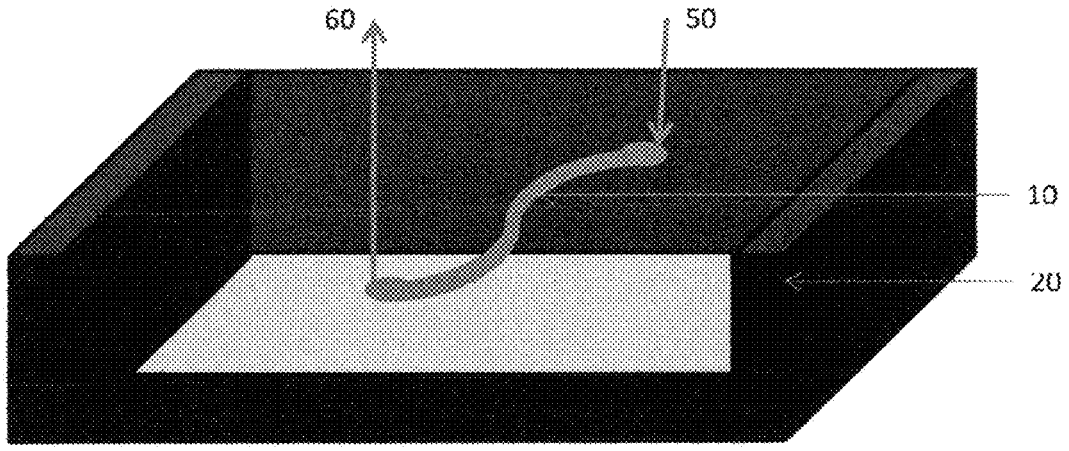
FIG. 3 shows a summary of steps 3a-3e of Process Method 3, whereby the ferrofluid is in a dynamic state and the molding material is molded against the movement and flow of the ferrofluid, creating a channel in the interior of the molding material.
Figure 3:
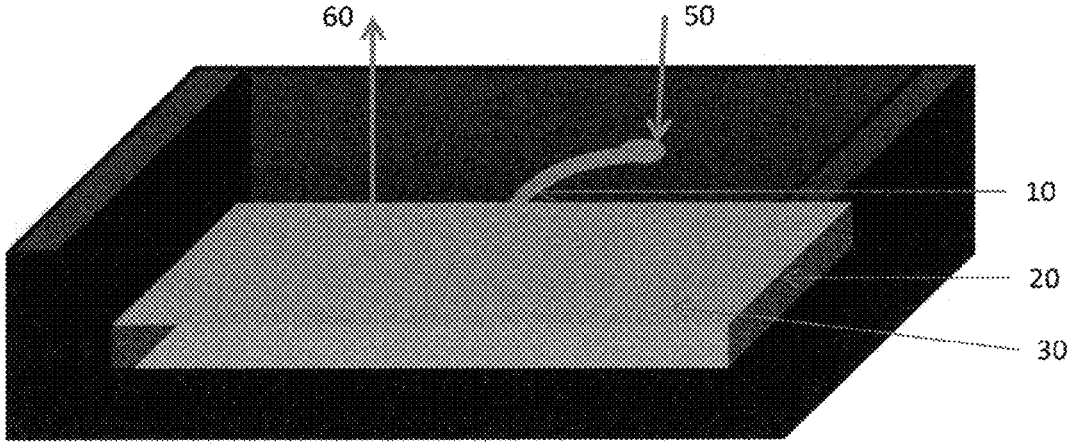
Figure 3:
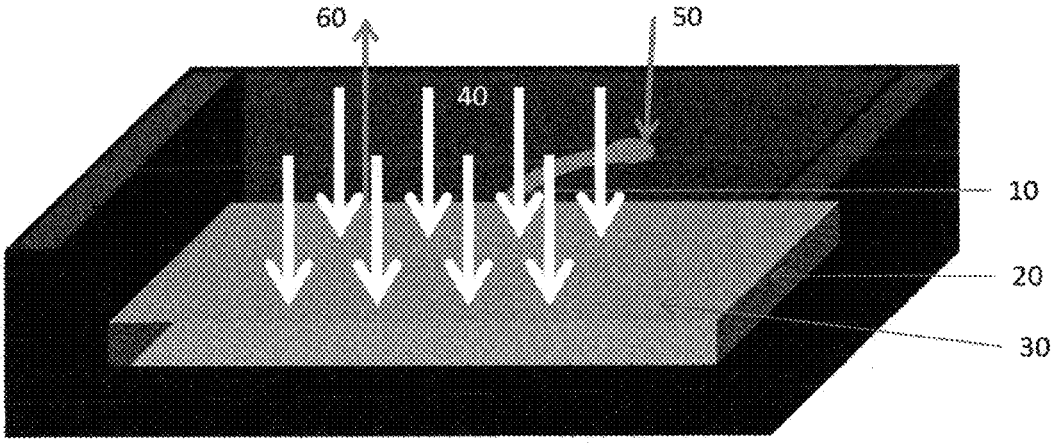
Figure 3:
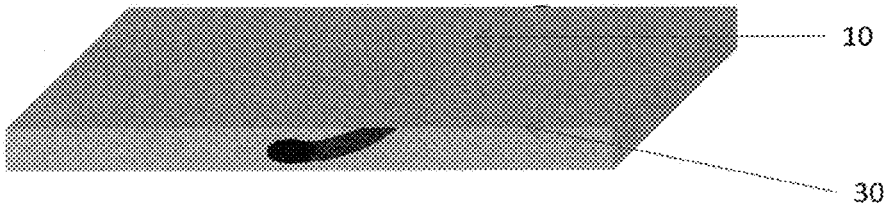
Figure 3:
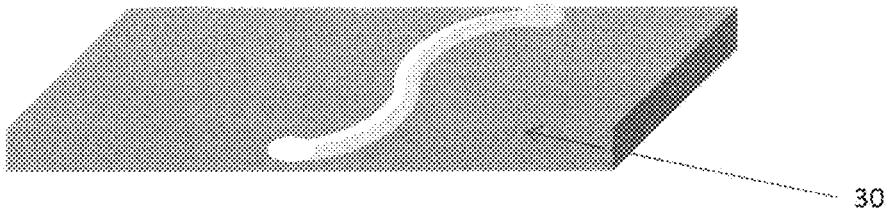

C. The ferrofluid substrate is in a dynamic state dictated by magnetics. The molding material effectively molds the flow pattern. The process concept is shown in FIG. 3.

Once applied, the molding material can be cured so as to create molded features. As is known to those skilled in the art, the process of curing the molding material is dependent upon the molding material used, as well as other parameters such as the volume of the final mold to be created. For example, a photopolymer requires curing by exposure to ultraviolet light; using melted plastics or metals requires curing by cooling; using powdered metals requires curing by the addition of heat. The resulting molded material can also additionally be cured by drying and baking.

Figure 8:
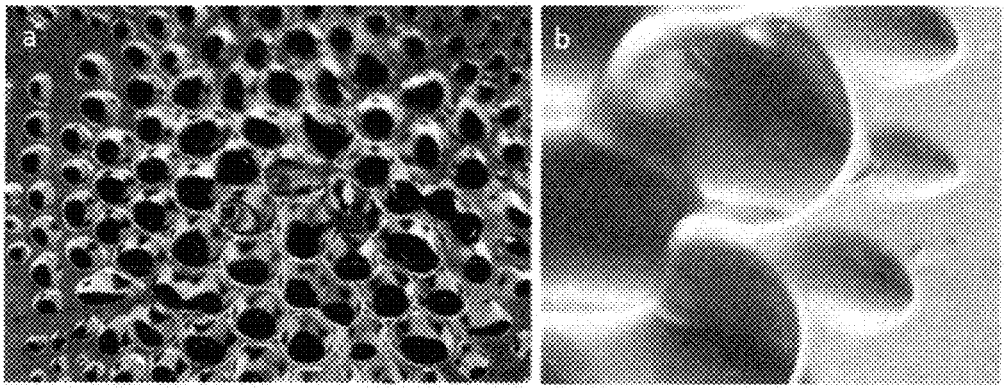
FIG. 8 shows an example of molded material in a static configuration.

Optionally, a further step in the method of the present invention may involve a wash of the remaining ferrofluid substrate, which remains in fluid form, enabling mold release, from the surface of the cured material. The wash used can be water or other chemicals that do not serve as a solvent for the molding material, such as water and acetone. Cleaning may be enabled by the immiscibility of the molding material and the ferrofluid substrate. Excess material can additionally be removed by the application of magnets to pull the remaining fluid from the surface of the molded material. FIG. 8*a* depicts a molded magnetic field prior to surface washing. FIG. 8*b* shows the same mold post-wash.

EXAMPLES

Example 1: Molding Channels in a Photopolymer Using a Static Magnetic Configuration. A Step-by-Step Process 1. Initially, configure the magnetic system to achieve desired field concentration in 3-D space. For example, an axially magnetized neodymium annular ring is used as the primary magnetic focus. A 100 micron gauge wire is then placed against the ring so that it is in line with the magnetic field lines of the ring. A thin stainless steel sheet is also placed above the system. The magnetic field strength is therefore concentrated at a point above the gauge wire and the stainless steel sheet.

2. A photopolymer is then applied to the surface of the metallic sheet within the magnetic field distribution of the magnetic system.
3. Ferrofluid substrate is input to the central space of the magnetic system within the photopolymer volume near the desired final position and above the surface of the metallic sheet. The ferrofluid substrate forms into the shape of a cylindrical tube in the region of the photopolymer volume where the magnetic field density is concentrated as it is attracted to the gauge wire. The volume (in microliters) of ferrofluid substrate will change the specific features of the field along the gauge wire. Higher volumes produce thicker lines around the field; smaller volumes produce thinner lines. The line width is not necessarily dependent on the width of the gauge wire—a 100 micron wire can produce 50 micron lines on the metallic sheet. See, e.g., FIG. 4*a-b*, that demonstrate images of the magnetized ferrofluid substrate.
4. (Optional step) A glass slide is placed adjacent the photopolymer layer to provide a flat surface for the top of the mold to be created.
5. The overall system is then exposed to a UV high intensity bulb.
6. The high intensity bulb is deployed for 10 seconds.
7. The system is left for 2 minutes to cool and cure.
8. The slide is peeled away from the metallic sheet.
9. The ferrofluid substrate is washed away using water.
10. The mold is complete. See FIGS. 4*c-d*, microscope images of molded features.

Example 2: Molding Channels in a Photopolymer Using a Dynamic Magnetic Configuration 1. Initially, the magnetic system is configured to achieve desired field concentration. For the example, two cubic neodymium magnets can be used as the magnetic foci, one larger than the other. The magnets are separated, with the field lines running in parallel directions. A razor guide (thin sheet metal) is then placed on the magnet surface, in line with the direction of the magnets' field lines. A thin stainless steel sheet is further placed on the system.
2. The system is then exposed to a UV high intensity bulb.
3. Photopolymer is then applied to a slide. The photopolymer is applied in a thin layer evenly on the slide, allowing creation of a flat underside to the molded surface.
4. (Optional step) The photopolymer is partially cured (or cooled) to change the resulting flow.
5. Ferrofluid substrate is then input above the surface of the metallic sheet near the weaker magnet. The fluid flow follows the path of the gauge wire toward the stronger magnet, effectively drilling a channel through the photopolymer.
6. During step 5, the high intensity UV bulb is deployed for 10 seconds.
7. The system is left for 2 minutes to cool and cure.
8. The slide is peeled away from the metallic sheet.
9. The ferrofluid substrate is washed away using water.
10. The mold is complete. See, e.g., FIG. 5, that demonstrates exemplary microscopic images of molded features.

The foregoing descriptions of various embodiments provide illustration of the inventive concepts. The descriptions are not intended to be exhaustive or to limit the disclosed invention to the precise form disclosed. Modifications or variations are also possible in light of the above teachings. The embodiments described above were chosen to provide the best application to thereby enable one of ordinary skill in the art to utilize the inventions in various embodiments and with various modifications as are suited to the particular use contemplated. All such modifications and variations are within the scope of the invention. Further, the disclosure of all patents, patent application and non-patent literature discussed herein is to be considered incorporated by reference in their entirety.

The invention claimed is:

1. A method for creating a dynamic mold comprising:
(a) selecting a mold, a molding material and a ferrofluid substrate;
(b) providing a magnetic system having a first magnet and at least a second magnet or metallic material, causing a non-uniform magnetic field density to form in a 3-D space;
(c) introducing the mold into the 3-D space within the magnetic system;
(d) introducing the ferrofluid substrate to the interior of the mold to form a shape resulting from the non-uniform magnetic field of the magnetic system;
(e) introducing the molding material to the interior of the mold to form a shape that is responsive to the mold and the ferrofluid substrate;
(f) at least partially curing the molding material, removing the ferrofluid substrate from the at least partially cured molding material, and optionally removing the at least partially cured molding material from the mold;
(g) wherein the selected molding material is a powdered metal.

2. The method of claim 1, wherein the metallic material is one of a metal gage wire, a metal rod, and a sheet metal.

3. The method of claim 1, wherein the curing of step (f) is achieved by applying a rapidly alternating magnetic field to the ferrofluid substrate.

4. A method for creating a dynamic mold comprising:
(a) selecting a mold, a molding material and a ferrofluid substrate;
(b) providing a magnetic system having a first magnet and at least a second magnet or metallic material, causing a non-uniform magnetic field density to form in a 3-D space;
(c) introducing the mold into the 3-D space within the magnetic system;
(d) introducing the ferrofluid substrate to the interior of the mold to form a shape resulting from the non-uniform magnetic field of the magnetic system;
(e) introducing the molding material to the interior of the mold to form a shape that is responsive to the mold and the ferrofluid substrate;
(f) at least partially curing the molding material, removing the ferrofluid substrate from the at least partially cured molding material, and optionally removing the at least partially cured molding material from the mold;
(g) introducing a metallic element between the first magnet and the at least a second magnet or metallic material to guide the mold material.

5. A method for creating a dynamic mold, comprising:

(a) providing a mold, a ferrofluid substrate, and a molding material;

(b) providing a magnetic system comprising at least one magnet and at least one metallic material, causing a non-uniform magnetic field density to form in 3-D space;

(c) combining the molding material and the ferrofluid substrate into the mold;

(d) shaping the ferrofluid substrate under the influence of the magnetic system;

(e) at least partially curing the molding material.

6. The method of claim 5, wherein the molding material is a powdered metal selected from the group consisting of stainless steel, ferritic steel, cobalt, copper, and austenitic nickel-chromium-based superalloy.

7. The method of claim 5, wherein the magnetic system creates an alternating magnetic field when energized with alternating current, and wherein induction heating results from the alternating magnetic field, effecting the curing of the molding material.

8. A method for creating a dynamic mold comprising:

(a) selecting a mold, a molding material and a ferrofluid substrate;

(b) introducing the molding material into a space within a magnetic system, wherein the magnetic system comprises at least one magnet and at least one metallic material configured to generate magnetic field lines having direction, wherein the direction of the magnetic field lines are capable of being non-perpendicular relative to a planar surface;

(c) contacting the molding material with the ferrofluid substrate; and, (d) at least partially curing the molding material during step (c), and removing the at least partially cured molding material from the ferrofluid substrate.

9. The method of claim 8, wherein the magnetic system of (b) includes two spaced apart cylindrical magnets connected by a wire, resulting in magnetic field lines capable of forming the ferrofluid substrate into an hourglass shape.

10. A mold prepared by the process of claim 8, wherein an internal feature is formed into an hourglass shape.

11. The method of claim 8, wherein the mold includes a non-magnetic fluid substrate.

* * * * *